US010486944B2

(12) United States Patent
Hayashi

(10) Patent No.: US 10,486,944 B2
(45) Date of Patent: Nov. 26, 2019

(54) OPERATION CONTROL APPARATUS FOR CRANE

(71) Applicant: FUJI ELECTRIC CO., LTD., Kanagawa (JP)

(72) Inventor: Takashi Hayashi, Tokyo (JP)

(73) Assignee: FUJI ELECTRIC CO., LTD., Kawasaki-shi, Kanagawa (JP)

( * ) Notice: Subject to any disclaimer, the term of this patent is extended or adjusted under 35 U.S.C. 154(b) by 0 days.

(21) Appl. No.: 16/166,380

(22) Filed: Oct. 22, 2018

(65) Prior Publication Data

US 2019/0177130 A1 Jun. 13, 2019

(30) Foreign Application Priority Data

Dec. 8, 2017 (JP) ..... 2017-235634

(51) Int. Cl.

| | |
|---|---|
| ***B66C 13/08*** | (2006.01) |
| ***B66C 13/06*** | (2006.01) |
| ***B66C 13/20*** | (2006.01) |
| ***B66C 13/46*** | (2006.01) |
| ***B66C 13/16*** | (2006.01) |

(52) U.S. Cl.

CPC ..... *B66C 13/08* (2013.01); *B66C 13/06* (2013.01); *B66C 13/20* (2013.01); *B66C 13/46* (2013.01); *B66C 13/16* (2013.01)

(58) Field of Classification Search

CPC ..... B66C 13/06; B66C 13/063; B66C 13/08; B66C 13/16; B66C 13/20; B66C 13/46; B66C 13/48

See application file for complete search history.

(56) References Cited

U.S. PATENT DOCUMENTS 4,147,330 A * 4/1979 Eik ..... B66D 1/52 254/266
4,354,608 A * 10/1982 Wudtke ..... B66C 13/02 212/256
4,547,857 A * 10/1985 Alexander ..... B66D 1/525 212/308
8,265,811 B2 * 9/2012 Kyllingstad ..... E21B 19/09 701/21

(Continued)

FOREIGN PATENT DOCUMENTS

JP 3742707 2/2006

*Primary Examiner* — Tyler J Lee
(74) *Attorney, Agent, or Firm* — IPUSA, PLLC

(57) ABSTRACT

An operation control apparatus for a crane for moving a suspended load in vertical and horizontal directions to a target position includes: a trajectory creating unit configured to create in advance a movement trajectory of the suspended load; a function creating unit configured to create a function indicating a relationship between a horizontal direction position and a height in the trajectory; a vertical direction command value updating unit configured to generate a vertical direction position command value by sequentially updating, in accordance with the horizontal direction position and based on the function, the vertical position at which the load should be present; a vertical direction control unit configured to generate a vertical direction speed command value based on the position command value; and a vertical direction driving unit configured to move the load in the vertical direction in accordance with the speed command value.

5 Claims, 3 Drawing Sheets

(56) References Cited

U.S. PATENT DOCUMENTS

| | | | | |
|---|---|---|---|---|
| 9,902,596 | B2 * | 2/2018 | Morrow | B66C 13/46 |
| 2005/0232626 | A1 * | 10/2005 | Schulte | B66C 13/063<br>396/515 |
| 2007/0289931 | A1 * | 12/2007 | Henriksson | B66C 13/063<br>212/274 |
| 2011/0066394 | A1 * | 3/2011 | Schneider | B66C 13/16<br>702/101 |
| 2011/0076130 | A1 * | 3/2011 | Stocker | B66C 13/46<br>414/815 |
| 2012/0092643 | A1 * | 4/2012 | Rintanen | B66C 13/46<br>356/4.01 |
| 2012/0296519 | A1 * | 11/2012 | Eberharter | B63B 27/10<br>701/34.4 |
| 2013/0120577 | A1 * | 5/2013 | Austefjord | B66C 13/02<br>348/148 |
| 2013/0345857 | A1 * | 12/2013 | Lee | G01S 5/16<br>700/229 |
| 2014/0107971 | A1 * | 4/2014 | Engedal | B66C 13/02<br>702/150 |
| 2015/0112638 | A1 * | 4/2015 | Morrow | B66C 13/46<br>702/182 |
| 2019/0078288 | A1 * | 3/2019 | Wu | E02F 3/431 |

* cited by examiner

OPERATION CONTROL APPARATUS FOR CRANE

CROSS-REFERENCE TO RELATED APPLICATION

The present application is based on and claims priority to Japanese Priority Application No. 2017-235634 filed on Dec. 8, 2017, the entire contents of which are hereby incorporated by reference.

BACKGROUND OF THE INVENTION

1. Field of the Invention

The present invention relates to an operation control apparatus for a crane for moving a suspended load in a vertical direction and a horizontal direction to transfer the suspended load to a target position.

2. Description of the Related Art

When automatically operating a crane, in general, a movement trajectory of a suspended load is determined so as to avoid a collision with an obstacle, and an acceleration/deceleration pattern for moving in the horizontal direction is determined to perform the operation so as to reduce a swing of the suspended load as much as possible other than acceleration/deceleration.

Normally, as a method of operating a crane for moving a suspended load along a predetermined trajectory, before the operation of the crane is started, a hoisting height allowing movement of the suspended load in the horizontal direction and a horizontal direction position for starting lowering are determined in advance. Then, during the operation of the crane, when the suspended load reaches the hoisting height or the horizontal direction position, a movement in the horizontal direction and lowering are started respectively.

As an easiest method with respect to an acceleration/deceleration method for suppressing a swing of a suspended load, a method of accelerating/decelerating by a constant acceleration/deceleration such that the acceleration/deceleration time matches a vibration cycle of the suspended load when the length of a rope supporting the suspended load is constant is known. Also, Patent Document 1 discloses a vibration suppression method of determining, even when a rope length changes due to hoisting and lowering of a suspended load, an acceleration/deceleration pattern so as to suppress a swing of the suspended load at the completion time of acceleration/deceleration under a condition that the rope length change rate is constant.

RELATED-ART DOCUMENT

Patent Document

[Patent Document 1] Japanese Patent No. 3742707

In an actual operation control of a crane, there may be a case in which a strong wind occurs during the operation, for example. In such a case, the speed is desired to be changed during the operation so as to temporarily decelerate the speed and return the speed to the original speed upon the problem being solved. However, if the speed is changed only in the horizontal direction while hoisting or lowering the suspended load and moving the suspended load in the horizontal direction, for example, there may be a case in which the suspended load cannot follow a trajectory planned in advance. In the worst case there is also a possibility of collision with an obstacle.

In this case, by changing the hoisting speed and the lowering speed changed by the rate of changing the moving speed in the horizontal direction, it is possible to reduce the deviation from the planned trajectory. However, these speeds cannot be changed instantaneously and a certain amount of time is required for changing the speeds. Therefore, even with this method, the actual trajectory of the suspended load cannot be completely matched with the planned trajectory. Furthermore, in order to suppress the swing of the suspended load caused by the speed change, even if the acceleration/deceleration pattern is determined using the rope length change rate at the time of starting the speed change, there is no guarantee that the rope length change rate is constant until the speed change is completed. As a result, it is difficult to completely suppress the swing of the suspended load.

Hence, an object of the present invention is to provide an operation control apparatus for a crane that can change the speed in a state of maintaining a movement trajectory of a suspended load planned before an operation even when a speed change is required during an operation of the crane and that can suppress a swing of the suspended load during the speed change.

SUMMARY OF THE INVENTION

In view of the above, according to a first aspect of the invention, an operation control apparatus for a crane for moving a suspended load in a vertical direction and a horizontal direction to transfer the suspended load to a target position includes: a trajectory creating unit configured to create in advance a movement trajectory of the suspended load; a function creating unit configured to create a function indicating a relationship between a horizontal direction position and a height of the suspended load in the movement trajectory; a vertical direction command value updating unit configured to generate a vertical direction position command value by sequentially updating, in accordance with the horizontal direction position of the suspended load and based on the function, the vertical position at which the suspended load should be present; a vertical direction control unit configured to generate a vertical direction speed command value of the suspended load based on the vertical direction position command value; and a vertical direction driving unit configured to move the suspended load in the vertical direction in accordance with the vertical direction speed command value.

According to a second aspect of the invention, the operation control apparatus described in the first aspect further includes: a horizontal direction command value updating unit configured to sequentially update a horizontal direction position command value of the suspended load based on a speed change amount in the horizontal direction of the suspended load; a horizontal direction control unit configured to generate a horizontal direction speed command value of the suspended load based on the horizontal direction position command value; and a horizontal direction driving unit configured to move the suspended load in the horizontal direction in accordance with the horizontal direction speed command value.

According to a third aspect of the invention, the operation control apparatus described in the second aspect further includes: an acceleration/deceleration pattern calculating unit configured to use a first height corresponding to a horizontal direction position at a start time of a speed change in the horizontal direction of the suspended load, a second height corresponding to a horizontal direction position at a completion time of the speed change in the horizontal direction of the suspended load, and a time required for the speed change in the horizontal direction of the suspended load to calculate a change rate average value of a length of a support member that supports the suspended load and configured to generate, by using the calculated change rate average value, an acceleration/deceleration pattern of a speed change period so as to suppress a swing of the suspended load due to the speed change in the horizontal direction, wherein the horizontal direction command value updating unit updates the horizontal direction position command value based on the acceleration/deceleration pattern.

According to a fourth aspect of the invention, the operation control apparatus described in the third aspect further includes: an ideal swing angle calculating unit configured to calculate an ideal swing angle of the suspended load with respect to the support member in the speed change period under a condition that the change rate average value of the length of the support member is constant in the speed change period in the horizontal direction of the suspended load; and a swing stop control unit configured to calculate a correction amount so that a deviation between the ideal swing angle and an actual swing angle approaches zero and configured to correct the horizontal direction speed command value by the correction amount to suppress the swing in the horizontal direction of the suspended load.

According to a fifth aspect of the invention, in the operation control apparatus described in the fourth aspect, the ideal swing angle calculating unit is provided in the acceleration/deceleration pattern calculating unit.

According to an embodiment of the present invention, even when a speed change in the horizontal direction is required during an operation of a crane, it is possible to prevent a collision with an obstacle by changing the speed while maintaining a planned movement trajectory of a suspended load and to minimize a swing of the suspended load.

DETAILED DESCRIPTION OF THE EMBODIMENTS

Figure 4:
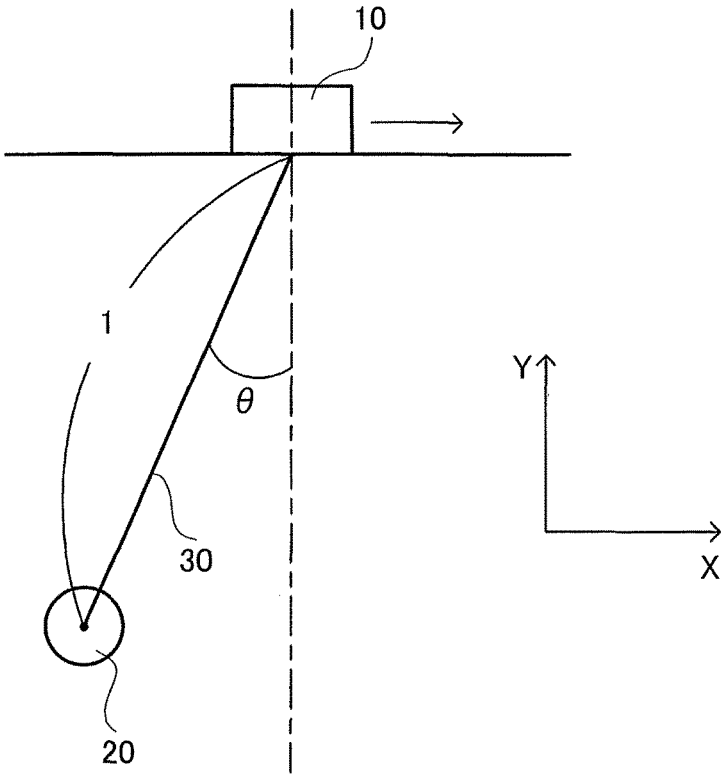
FIG. 4 is a schematic diagram of a trolley, a suspended load, and the like according to the embodiment of the present invention.

An embodiment of the present invention will be described below with reference to the drawings. First, FIG. 4 is a schematic diagram of a trolley 10, a suspended load 20, and the like according to the embodiment of the present invention. In FIG. 4, the trolley 10 can run (move) in the X direction (the horizontal direction) and the suspended load 20 is suspended by a rope 30 as a support member from the trolley 10. The suspended load 20 can be hoisted and lowered in the Y direction (the vertical direction). The support member may be a wire or the like other than the rope 30. Note that l indicates a rope length, and θ indicates a swing angle of the suspended load 20 with respect to the vertical line. Here, because a horizontal direction driving mechanism that runs the trolley 10 to move the suspended load 20 in the horizontal direction and a vertical direction driving mechanism that hoists and lowers the suspended load 20 to move in the vertical direction are not main parts of the present invention, their descriptions are omitted.

Figure 1:
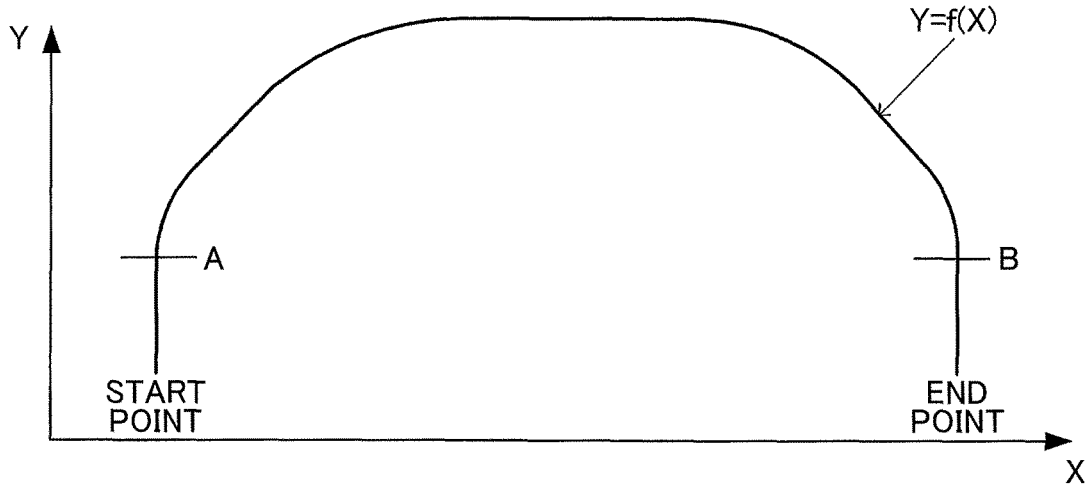
FIG. 1 is a schematic diagram illustrating a movement trajectory of a suspended load according to an embodiment of the present invention.

According to this embodiment, before starting an operation of a crane, a trajectory that the suspended load 20 should follow is created in advance as illustrated in FIG. 1 based on a start point and an end point of the suspended load 20, based on a position of an obstacle that the suspended load 20 should avoid, based on upper limit speeds in the respective horizontal and vertical directions, based on an appropriate acceleration/deceleration time, and the like. Then, a function $Y=f(X)$ for finding a height Y of the suspended load 20 on the trajectory from a position X in the horizontal direction is generated in a movement range in the horizontal direction of the suspended load 20 (the range of A to B in FIG. 1) within the trajectory described above.

During an operation of the crane, when the horizontal direction position of the suspended load 20 is in the above described range of A to B, the suspended load 20 is moved while sequentially updating, in accordance with $Y=f(X)$, the height Y at which the suspended load 20 should be present with respect to the horizontal direction position X. For example, when a strong wind occurs during the movement of the suspended load 20 and a speed change in the horizontal direction is inevitable, the actual horizontal direction position and the vertical direction position of the suspended load 20 deviate from the trajectory of FIG. 1. In such a case, in the present embodiment, according to the movement trajectory of FIG. 1, the height Y at which the suspended load 20 should be present is obtained from $Y=f(X)$ in accordance with the actual horizontal position X of the suspended load 20. Then, based on the obtained result, by controlling the speeds in the respective horizontal and vertical directions of the suspended load 20, the suspended load 20 can be moved according to the planned trajectory.

At least at the start time and the completion time of movement in the horizontal direction, the movement speed of the suspended load 20 in the horizontal direction needs to be changed during an operation of the crane. Further, when a speed change is required due to an occurrence of an abnormal event such as a strong wind, the movement speed of the suspended load 20 in the horizontal direction needs to be changed during an operation of the crane. A specific processing procedure according to the present embodiment in a case where a speed change is required as described above will be described with reference to the flowchart illustrated in FIG. 2.

When the speed is required to be changed, first, the current height $Y_1=f(X_1)$ of the suspended load 20 at the horizontal direction position $X_1$ of the suspended load 20 at the start time of changing the speed is obtained in step S1. Because the speed has not been changed yet at this time point, $Y_1$ corresponding to $X_1$ is on the trajectory illustrated in FIG. 1.

Next, the movement distance ΔX of the suspended load 20 during the speed change is found, and the horizontal direction position $X_2$ of the suspended load 20 at the completion time of the speed change is found to obtain the height $Y_2$ of the suspended load 20 corresponding to the horizontal direction position $X_2$ in step S2. That is, when a time T is spent from the start time point of the speed change such that the speed $V_1$ of the suspended load 20 is changed by $\Delta V$ to the speed $V_2$ ($=V_1+\Delta V$), $\Delta X$ can be found as $\Delta X=(V_1+V_2)T/2$ by using the average value of the speeds $(V_1+V_2)/2$. Furthermore, for the horizontal direction position $X_2$ at the completion time of the speed change, $X_2=X_1+\Delta X$. Therefore, the height $Y_2$ of the suspended load 20 corresponding to the position $X_2$ can be found as $Y_2=f(X_2)=f(X_1+\Delta X)$. That is, in this step S2, with respect to the horizontal direction position $X_2$ reached when the horizontal direction speed of the suspended load 20 is changed, the height $Y_2$ where the suspended load 20 should originally be located is found.

Subsequently, a change rate average value $\nu$ within the speed change time T of the length of the rope supporting the suspended load 20 is calculated in step S3. Because this change rate average value $\nu$ of the rope length is equal to the change rate average value of the height before and after the speed change time T, it can be found as $\nu=-(Y_2-Y_1)/T$.

Further, when changing the speed of the suspended load 20 from $V_1$ to $V_2=V_1+\Delta V$, an acceleration that can suppress a swing of the suspended load 20 in a case where the change rate average value $\nu$ of the rope length is constant is found, and the speed is changed by using an acceleration/deceleration pattern based on the found acceleration in step S4.

For example, an acceleration/deceleration pattern is considered in a case of controlling the swing angle $\theta$ [rad] of the suspended load 20 during a speed change to form the mathematical equation 1 to suppress a swing of the suspended load 20 at the completion time of the speed change ($\tau=1$).

$$\theta=-A\tau^2(1-\tau)^2 \qquad \text{[Mathematical equation 1]}$$

(Here, A is a function of $\Delta V$, $\tau$ is the ratio between the elapsed time t from the start of speed change and the speed change time T, and $\tau=t/T$)

For example, as shown in the mathematical equation 10 of Patent Document 1 mentioned above, the equation of motion in a case where the length of the rope changes as in a case where the suspended load 20 is moved in the horizontal direction and the vertical direction by a crane can be represented by the following mathematical equation 2. Note that in the mathematical equation 2, friction due to air resistance to the suspended load 20 and energy loss due to bending of the rope 30 are ignored.

$$d^2Z/dt^2+(g/l)Z=-d^2X/dt^2 \qquad \text{[Mathematical equation 2]}$$

(Here, $Z=l\theta$, $l=l_0+\nu t$, g: gravitational acceleration, $l_0$: initial rope length)

The acceleration in the horizontal direction ($d^2X/dt^2$) such that the speed changes by $\Delta V$ at $t=T$, that is, at $\tau=1$ (at the completion time of speed change) is calculated, based on the left side of the above described mathematical equation 2, by the following mathematical equation 3 as indicated by the mathematical equation 14 of Patent Document 1.

$$d^2X/dt^2=(30\Delta V/gT^3)[l_0(2-12\tau+12\tau^2)+(\nu T)(6\tau-24\tau^2+20\tau^3)+(gT^2)\tau^2(1-\tau)^2] \qquad \text{[Mathematical equation 3]}$$

Note that although an actual change rate of the rope length when accelerating in the horizontal direction is not constant, by assuming the change rate average value $\nu$ of the rope length constant, a swing of the suspended load 20 due to a speed change can be reduced.

Also, the ideal swing angle $\theta^*$ during a speed change when acceleration is applied to the suspended load 20 as described above is represented by the following mathematical equation 4 based on the mathematical equation 1 described above.

$$\theta^*=-(30\Delta V/gT)\tau^2(1-\tau)^2 \qquad \text{[Mathematical equation 4]}$$

As the actual swing angle $\theta$ during the speed change is closer to the ideal swing angle $\theta^*$, a swing remaining at the completion time of the speed change can approach zero. Therefore, by applying swing stop control of correcting the speed in the horizontal direction so that the deviation $\Delta\theta=\theta^*-\theta$ of the swing angle approaches zero, it is possible to move the suspended load 20 while further suppressing the swing of the suspended load 20.

Although the above description is for suppressing the swing of the suspended load 20 during a speed change based on the mathematical equations 1 and 4, other than this, for example, the speed can be changed while suppressing the swing of the suspended load 20 based on the following mathematical equation 5, for example.

$$\theta=-A(1-\cos\omega t) \qquad \text{[Mathematical equation 5]}$$

(Here, $\omega=2\pi/T$)

In this case, the acceleration ($d^2X/dt^2$) and the ideal swing angle $\theta^*$ of the suspended load 20 may be given as in the following mathematical equations 6 and 7.

$$d^2X/dt^2=(\Delta V/gT)[g(1-\cos\omega t)+2\nu\omega\sin\omega t+(l_0+\nu t)\omega^2\cos\omega t] \qquad \text{[Mathematical equation 6]}$$

$$\theta^*=-(\Delta V/gT)(1-\cos\omega t) \qquad \text{[Mathematical equation 7]}$$

Figure 3A:
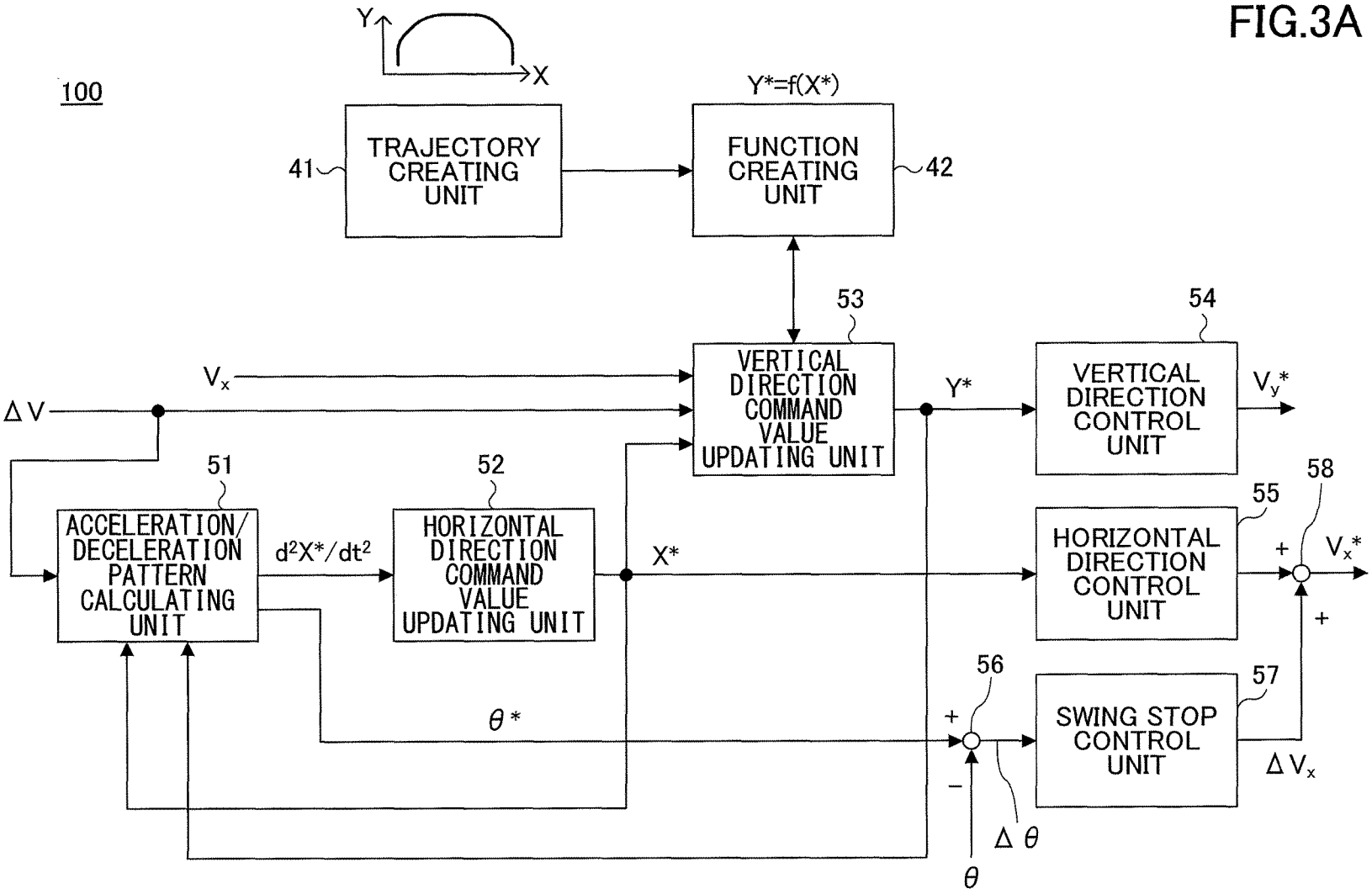
FIG. 3A is a control block diagram illustrating a main part of an operation control apparatus according to the present embodiment.
Figure 3B:
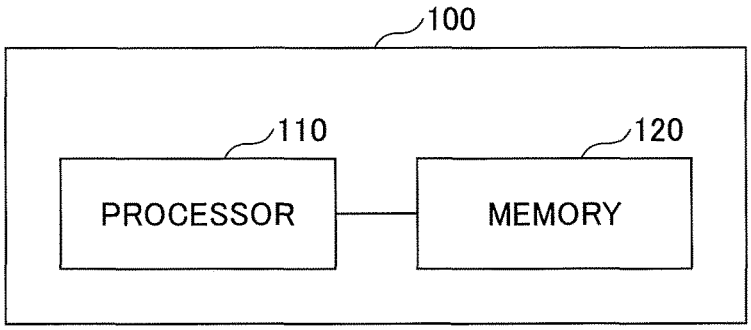
FIG. 3B is a block diagram illustrating a hardware configuration of the operation control apparatus according to the present embodiment.

FIG. 3A is a control block diagram illustrating a main part of an operation control apparatus 100 for a crane according to the present embodiment. FIG. 3B is a block diagram illustrating a hardware configuration of the operation control apparatus 100 according to the present embodiment. Each function illustrated in FIG. 3A can be realized by a processor 110 and a memory 120 as illustrated in FIG. 3B. In FIG. 3A, a trajectory creating unit 41 stores the movement trajectory of FIG. 1 created in advance. A function creating unit 42 creates a function $Y^*=f(X^*)$ from the movement trajectory stored in the trajectory creating unit 41. A vertical direction command value updating unit 53 can reference the function $Y^*=f(X^*)$. Further, to the vertical direction command value updating unit 53, a horizontal direction speed Vx, a speed change amount $\Delta V$ in the horizontal direction, and a horizontal direction command value $X^*$ of the suspended load 20 updated by a horizontal direction position command value updating unit 52, which will be described later below, are input.

On a premise that a horizontal direction position $X_1$ at the time of starting a speed change matches a position command value $X_1^*$, the vertical direction command value updating unit 53 uses the function $Y^*=f(X^*)$ of the function creating unit 42 to find a height $Y_1$ of the suspended load 20. Also, the vertical direction command value updating unit 53 calculates a speed $V_2$ ($=V_1+\Delta V$) from $V_1$ at the time of starting the speed change and from the speed change amount $\Delta V$ based on the sequentially input horizontal direction speed Vx. Then, the vertical direction command value updating unit 53 finds $\Delta X$ from $\Delta X=(V_1+V_2)T/2$. Using the function $Y^*=f(X^*)$, the vertical direction command value updating unit 53 finds, from the horizontal direction position $X_2$ ($=X_1+\Delta X$) at the completion time of the speed change, a height $Y_2$ that the suspended load 20 should reach at the completion time of the speed change.

Conversely, an acceleration/deceleration pattern calculating unit 51 calculates, for example, the right side of the mathematical equation 3 and outputs the calculated result as an acceleration command value ($d^2X^*/dt^2$) in the horizontal direction. Note that the change rate average value ν of the rope length in the right side of the mathematical equation 3 can be calculated by using the vertical direction position command value Y* calculated by the vertical direction command updating unit 53. That is, ν can be calculated by using the first and second heights $Y_1$ and $Y_2$ from $\nu=-(Y_2-Y_1)/T$, which is described above.

The horizontal direction command value updating unit 52 integrates the acceleration command value ($d^2X^*/dt^2$) twice to calculate the horizontal direction position command value X*. This horizontal direction position command value X* corresponds to the horizontal direction position $X_2$ to which the suspended load 20 reaches at the completion time of the speed change based on ΔV. Based on the horizontal direction position command value X* and a horizontal direction position detection value X (not illustrated), the horizontal direction control unit 55 generates a horizontal direction speed command value $V_x$* for driving the trolley 10 to move the suspended load 20 in the horizontal direction. Further, based on the vertical direction position command value Y*=f(X*) at the horizontal direction position command value X* obtained by the vertical direction command value updating unit 53, the vertical direction control unit 54 generates a vertical direction speed command value $V_x$* for hosting/lowering the suspended load 20 (rope 30), and controls a vertical direction driving mechanism (not illustrated) according to the generated speed command value $V_x$*.

Note that the acceleration/deceleration pattern calculating unit 51 calculates an ideal swing angle θ* according to, for example, the mathematical equation 4 described above. Causing a subtractor 56 to find thee deviation Δθ between the ideal swing angle θ* and a current swing angle θ, a swing stop control unit 57 performs calculation so that the deviation Δθ approaches zero to output a correction amount $\Delta V_x$. This correction amount $\Delta V_x$ is added by an adder 58 to the output of the vertical direction control unit 55 to generate a final horizontal direction speed command value $V_x$*. Then, by controlling a horizontal direction driving mechanism (not illustrated) according to the generated speed command value $V_x$*, it is possible to transfer the suspended load 20 in the horizontal direction while minimizing the swing angle θ.

Figure 2:
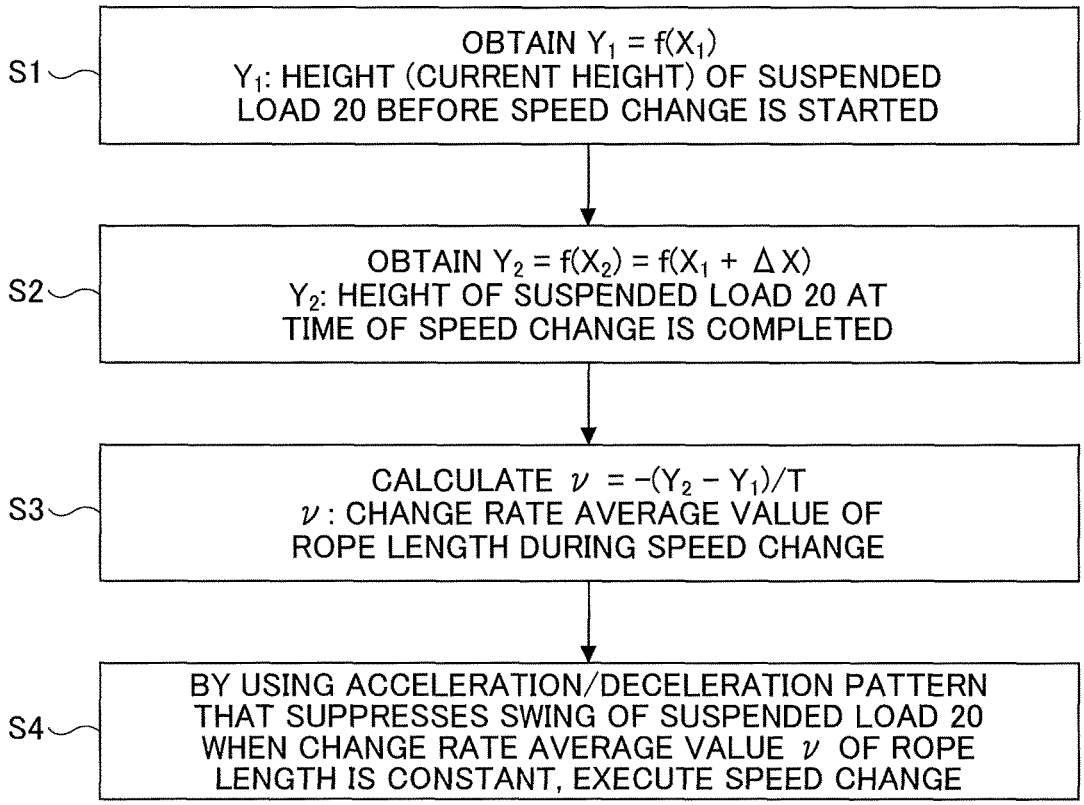
FIG. 2 is a flowchart illustrating a processing procedure for when a movement speed in the horizontal direction is changed according to the embodiment of the present invention.

As described above, according to the present embodiment, in an automatic operation of a crane, when the movement speed in the horizontal direction of the suspended load 20 is changed, a predetermined acceleration/deceleration pattern is generated in accordance with the procedure of FIG. 2. Then, the height Y is sequentially updated in accordance with the horizontal direction position X based on the generated acceleration/deceleration pattern. Thereby, it is possible to perform the speed change while maintaining a movement trajectory of the suspended load 20 planned before the operation, and furthermore, it is possible to reduce a swing of the suspended load 20. Further, by correcting the horizontal direction speed command value $V_x$* based on the difference between an ideal swing angle θ* generated by the acceleration/deceleration pattern calculating unit 51 and an actual value θ, it is possible to further suppress the swing of the suspended load 20.

What is claimed is:

1. An operation control apparatus for a crane for moving a suspended load in a vertical direction and a horizontal direction to transfer the suspended load to a target position, the operation control apparatus comprising:

a trajectory creating unit configured to create in advance a movement trajectory of the suspended load;

a function creating unit configured to create a function indicating a relationship between a horizontal direction position and a height of the suspended load in the movement trajectory;

a vertical direction command value updating unit configured to generate a vertical direction position command value by sequentially updating, in accordance with the horizontal direction position of the suspended load and based on the function, the vertical position at which the suspended load should be present;

a vertical direction control unit configured to generate a vertical direction speed command value of the suspended load based on the vertical direction position command value; and a vertical direction driving unit configured to move the suspended load in the vertical direction in accordance with the vertical direction speed command value.

2. The operation control apparatus according to claim 1, further comprising:

a horizontal direction command value updating unit configured to sequentially update a horizontal direction position command value of the suspended load based on a speed change amount in the horizontal direction of the suspended load;

a horizontal direction control unit configured to generate a horizontal direction speed command value of the suspended load based on the horizontal direction position command value; and a horizontal direction driving unit configured to move the suspended load in the horizontal direction in accordance with the horizontal direction speed command value.

3. The operation control apparatus according to claim 2, further comprising:

an acceleration/deceleration pattern calculating unit configured to use a first height corresponding to a horizontal direction position at a start time of a speed change in the horizontal direction of the suspended load, a second height corresponding to a horizontal direction position at a completion time of the speed change in the horizontal direction of the suspended load, and a time required for the speed change in the horizontal direction of the suspended load to calculate a change rate average value of a length of a support member that supports the suspended load and configured to generate, by using the calculated change rate average value, an acceleration/deceleration pattern of a speed change period so as to suppress a swing of the suspended load due to the speed change in the horizontal direction, wherein the horizontal direction command value updating unit updates the horizontal direction position command value based on the acceleration/deceleration pattern.

4. The operation control apparatus according to claim 3, further comprising:

an ideal swing angle calculating unit configured to calculate an ideal swing angle of the suspended load with respect to the support member in the speed change period under a condition that the change rate average value of the length of the support member is constant in the speed change period in the horizontal direction of the suspended load; and a swing stop control unit configured to calculate a correction amount so that a deviation between the ideal swing angle and an actual swing angle approaches zero and configured to correct the horizontal direction speed command value by the correction amount to suppress the swing in the horizontal direction of the suspended load.

5. The operation control apparatus according to claim 4, wherein the ideal swing angle calculating unit is provided in the acceleration/deceleration pattern calculating unit.

* * * * *